US010383420B2

(12) United States Patent
Cetinkaya

(10) Patent No.: US 10,383,420 B2
(45) Date of Patent: Aug. 20, 2019

(54) HAIR HIGHLIGHTING DEVICE

(71) Applicant: Mitat Cetinkaya, London (GB)

(72) Inventor: Mitat Cetinkaya, London (GB)

( * ) Notice: Subject to any disclaimer, the term of this patent is extended or adjusted under 35 U.S.C. 154(b) by 0 days.

(21) Appl. No.: 14/782,557

(22) PCT Filed: Mar. 26, 2014

(86) PCT No.: PCT/GB2014/050950
§ 371 (c)(1),
(2) Date: Oct. 5, 2015

(87) PCT Pub. No.: WO2014/167284
PCT Pub. Date: Oct. 16, 2014

(65) Prior Publication Data

US 2016/0029765 A1 Feb. 4, 2016

(30) Foreign Application Priority Data

Apr. 9, 2013 (GB) ..... 1306387.0

(51) Int. Cl.
*A45D 19/18* (2006.01)
*A45D 19/00* (2006.01)
*A45D 19/02* (2006.01)

(52) U.S. Cl.
CPC ..... *A45D 19/0016* (2013.01); *A45D 19/0008* (2013.01); *A45D 19/02* (2013.01); *A45D 2019/0091* (2013.01); *A45D 2200/055* (2013.01)

(58) Field of Classification Search
CPC .... A45D 19/00; A45D 19/02; A45D 19/0008; A45D 24/28; A45D 24/22; A45D 24/24; A45D 24/26; A45D 2019/0091; A45D 2019/0041; A45D 2019/0066; A45D 2019/0083; B65H 71/00
See application file for complete search history.

(56) References Cited

U.S. PATENT DOCUMENTS 2,705,499 A * 4/1955 Breeze ..... A45D 19/0008 132/109
4,576,311 A * 3/1986 Horton ..... A61L 9/12 118/235
5,060,679 A * 10/1991 Christopher ..... A45D 19/02 132/114
5,672,206 A * 9/1997 Gorman ..... A47K 10/32 118/313
6,237,608 B1 * 5/2001 Kari ..... A45D 19/0008 132/200

(Continued)

FOREIGN PATENT DOCUMENTS

DE 4041742 A1 6/1992
WO 2007132088 A2 11/2007

*Primary Examiner* — Rachel R Steitz
(74) *Attorney, Agent, or Firm* — Fay Sharpe LLP

(57) ABSTRACT

A hair-highlighting device has a handle and a reservoir for storing a highlighting composition. The device is adapted to dispense a tape of barrier material and also adapted to simultaneously dispense highlighting composition via a reservoir outlet to a lock of hair. The device comprises a manually operated mechanism to expel highlighting composition from the reservoir such that when the device is in use a user may vary the amount of highlighting composition dispensed from the reservoir by varying the pressure that is applied to the mechanism.

27 Claims, 7 Drawing Sheets

(56) References Cited

U.S. PATENT DOCUMENTS

| | | | | |
|---|---|---|---|---|
| 6,378,529 | B1 * | 4/2002 | Clemente Marco | A45D 19/02 132/111 |
| 6,613,144 | B1 * | 9/2003 | Loertscher | A47K 10/32 118/302 |
| 7,101,441 | B2 * | 9/2006 | Kennard | A47K 10/34 118/42 |
| 7,357,137 | B2 * | 4/2008 | Husband | A45D 19/0025 132/202 |
| 8,573,232 | B2 * | 11/2013 | Glenn, Jr. | A45D 19/0008 132/108 |
| 9,155,371 | B2 * | 10/2015 | Wagner | A45D 19/02 |
| 2005/0028835 | A1 | 2/2005 | Husband et al. | |
| 2007/0215170 | A1 * | 9/2007 | Kennedy | A45D 19/02 132/112 |
| 2009/0101159 | A1 * | 4/2009 | Bonnafous | A45D 19/02 132/112 |
| 2009/0282961 | A1 * | 11/2009 | Jones | B26D 5/10 83/436.5 |
| 2014/0026810 | A1 * | 1/2014 | Lazzaroni | B29C 65/5092 118/231 |
| 2014/0366904 | A1 * | 12/2014 | Samain | A45D 19/0008 132/200 |

* cited by examiner

HAIR HIGHLIGHTING DEVICE

CROSS REFERENCE TO RELATED APPLICATIONS

This is a National Stage of International Application No. PCT/GB2014/050950, filed Mar. 26, 2014, which claims the priority of British Application No. 1306387.0, filed Apr. 9, 2013, the entire disclosures of which are hereby incorporated by reference in their entirety.

BACKGROUND OF THE INVENTION

1. Field of the Invention

The present invention relates to a hair-highlighting device.

2. Description of the Prior Art

Manually highlighting hair is a lengthy process, requiring a skilled hairdresser to isolate strands or locks of hair, applying a highlighting composition and encase the respective strands or locks in a barrier material, typically foil.

Attempts have been made to provide a device that is capable of automating the process; such prior art attempts include the disclosures of US2005028835 and DE4041742. However, none of the devices produced to date allow a hairdresser the level of control over the process that they have by manually applying a highlighting composition.

The present invention seeks to address this issue.

SUMMARY OF THE INVENTION

According to the present invention there is provided a hair-highlighting device having a handle, a reservoir for storing a highlighting composition, the device being adapted to dispense a tape of barrier material and being adapted to simultaneously dispense the highlighting composition via a reservoir outlet to a lock of hair, characterized in that device comprises a manually operated mechanism to expel highlighting composition from the reservoir such that when the device is in use a user may vary the amount of highlighting composition dispensed from the reservoir by varying the pressure that is applied to the manually operated mechanism.

By providing a manually operated mechanism that allows a user to control the amount of highlighting composition dispensed the user is able to apply the desired amount of composition to a lock of hair. The amount may vary depending upon the requirements of the person whose hair is being dyed and upon the type of highlighting composition being used. Thus in comparison to prior art arrangements the user has much greater control over the highlighting process and is able to produce more customized and artistic results. Furthermore, the device of the present invention may be used by a single hairdresser, without an assistant, thereby cutting the cost of the highlighting process.

Preferably the device comprises an attachment to retain a roll of barrier material such that the roll is rotatably attached to the device.

By providing an attachment to retain a roll of barrier material the device may easily operate as a single unit.

Preferably the mechanism to expel the highlighting composition comprises a button adjacent the handle. Preferably the button is operable by a user's thumb.

The provision of a button that is preferably thumb-operated is the ideal arrangement as it allows the user to grip the handle of the device with the remainder of their hand whilst providing full control over the amount of highlighting composition released.

Preferably the reservoir outlet is formed so as to release highlighting composition substantially across the width of the tape of barrier material. Preferably the reservoir outlet is in the form of a slot.

By expelling highlighting composition from the reservoir across the full width of the tape of barrier material a lock of hair may be readily coated.

Preferably the device comprises a roller adjacent the reservoir outlet to assist application of highlighting composition.

The provision of roller aids a continuous and even application of highlighting composition.

Preferably the roller is moveable between a first position wherein when the device is in use the roller is clamped upon a lock of hair in the device and a second position wherein the roller is raised away from the lock of hair.

By allowing a user to move the roller between a position where it clamps a lock of hair and an inactive position the user is able to rearrange strands of hair if necessary and also to dispense lengths of the tape of barrier material without applying highlighting composition to it.

Preferably the roller is biased towards its first position.

Biasing the roller towards its first position means that it is in an active position when the user is not interfering with it.

Preferably the roller may be moved into its second position by a user applying pressure to a lever adjacent the handle.

The provision of a lever adjacent the handle allows for a user to move the roller into its second position most easily.

Preferably the roller is formed of a sponge material.

A sponge material is an ideal material to assist application of the highlighting composition.

In some embodiments the barrier material is a transparent plastic film.

Preferably the device comprises a cutter operable to cut the barrier material. Preferably the cutter is operable by a trigger adjacent the handle. Preferably the cutter is adapted to make an incision on one side of the tape of barrier material.

The provision of a cutter allows a user to readily cut a length of barrier material off from the roll once a lock of hair has been treated. Such a cutter may not be necessary when a readily tearable barrier material such as foil is employed. However, when a barrier material such as a transparent plastic film is employed a cutter may be essential.

Preferably the device is formed of first and second parts hingedly attached adjacent an end of the handle, the parts being moveable between an open position wherein the lock of hair may be positioned in the device and a closed position wherein the barrier material and highlighting composition may be applied to the lock of hair.

The provision of first and second parts that are hingedly attached is a convenient arrangement.

Preferably the reservoir is refillable.

By providing a refillable reservoir the device may be used repeatedly. The reservoir may be washed between use when desired. Further any pre-prepared colour composition or combination of colours or bleach may be put into the reservoir by the user thereby allowing for great versatility in the composition being dispensed.

Preferably the reservoir may hold at least 100 ml of highlighting composition. More preferably the reservoir may hold at least 150 ml of highlighting composition. More preferably the reservoir may hold at least 200 ml of highlighting composition. More preferably the reservoir may hold at least 250 ml of highlighting composition.

The present invention will now be explained by way of example with reference to the accompanying drawings. In the drawings, like reference characters refer to parts throughout the views in which:

DETAILED DESCRIPTION OF THE PREFERRED EMBODIMENT

Figure 1:
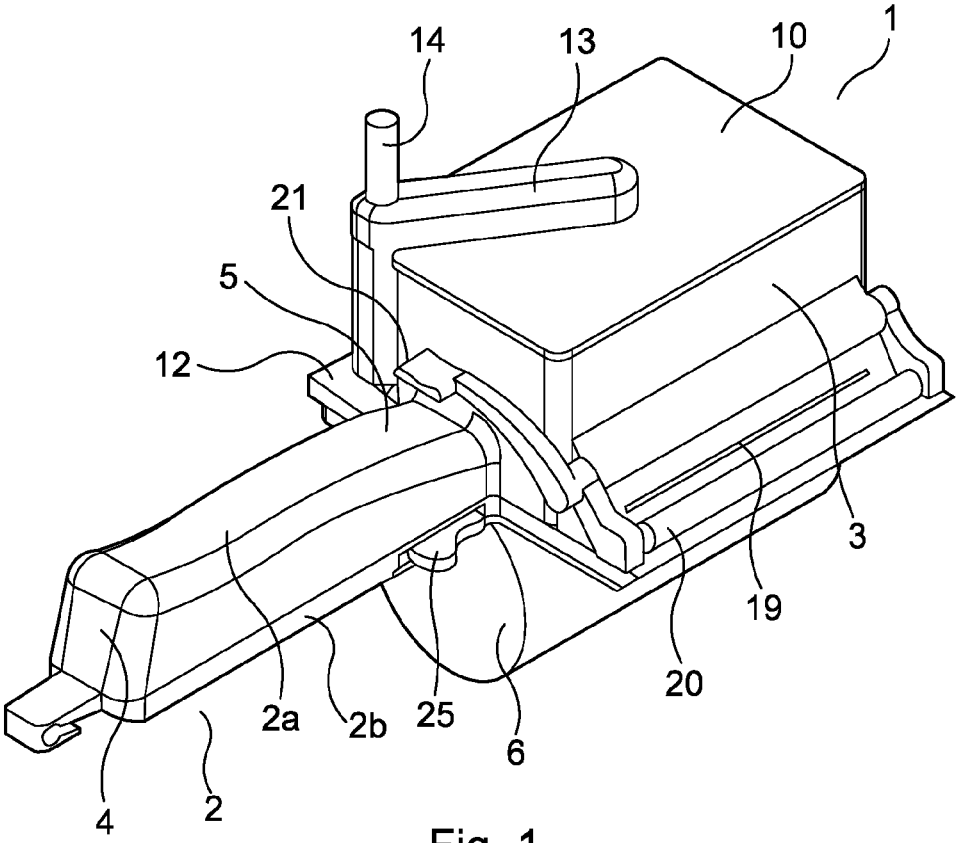
FIG. 1 is a perspective view of a device made in accordance the present invention.
Figure 2:
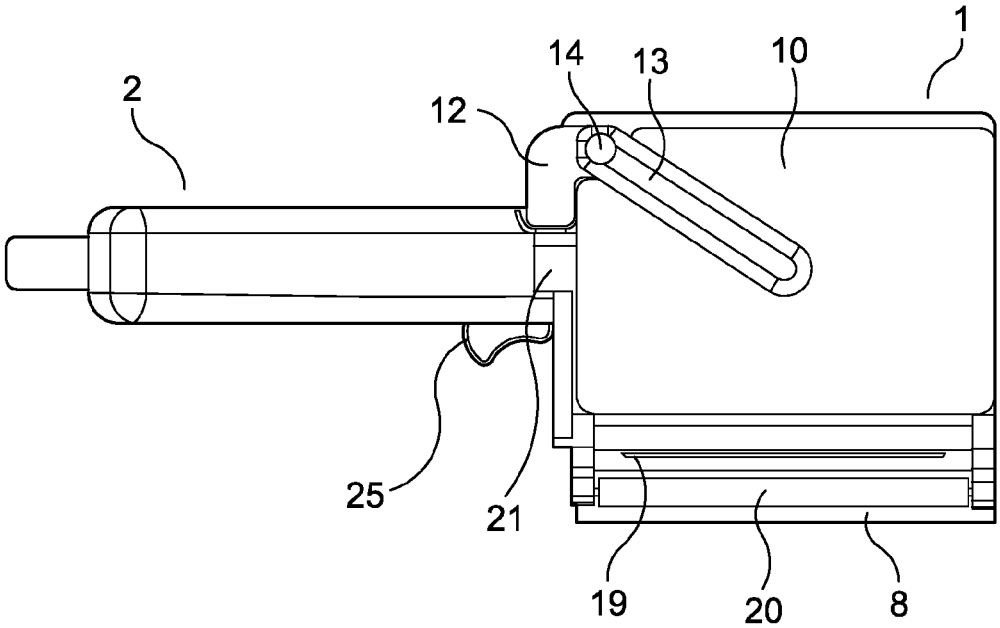
FIG. 2 is a view of the top of the device of FIG. 1.
Figure 3:
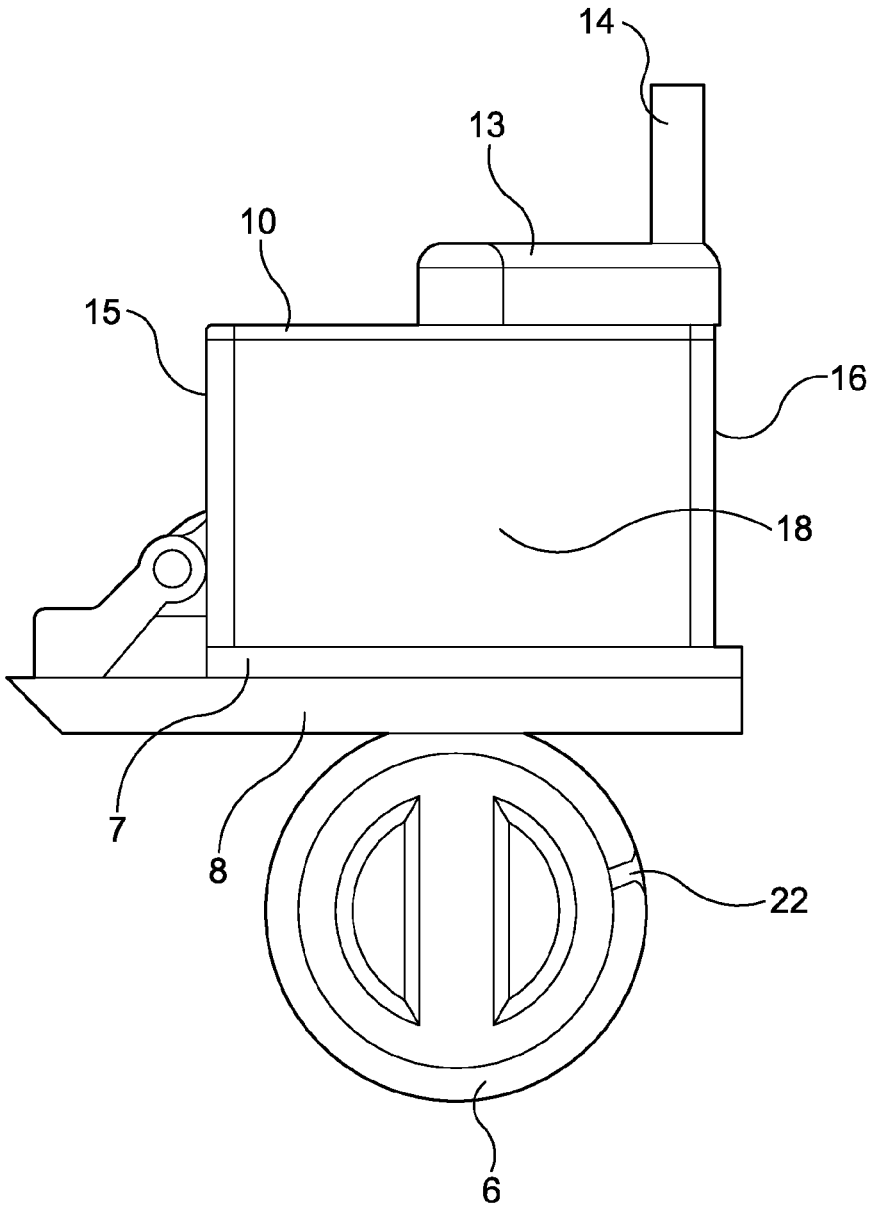
FIG. 3 is a view of a side of the device of FIG. 1.
Figure 4:
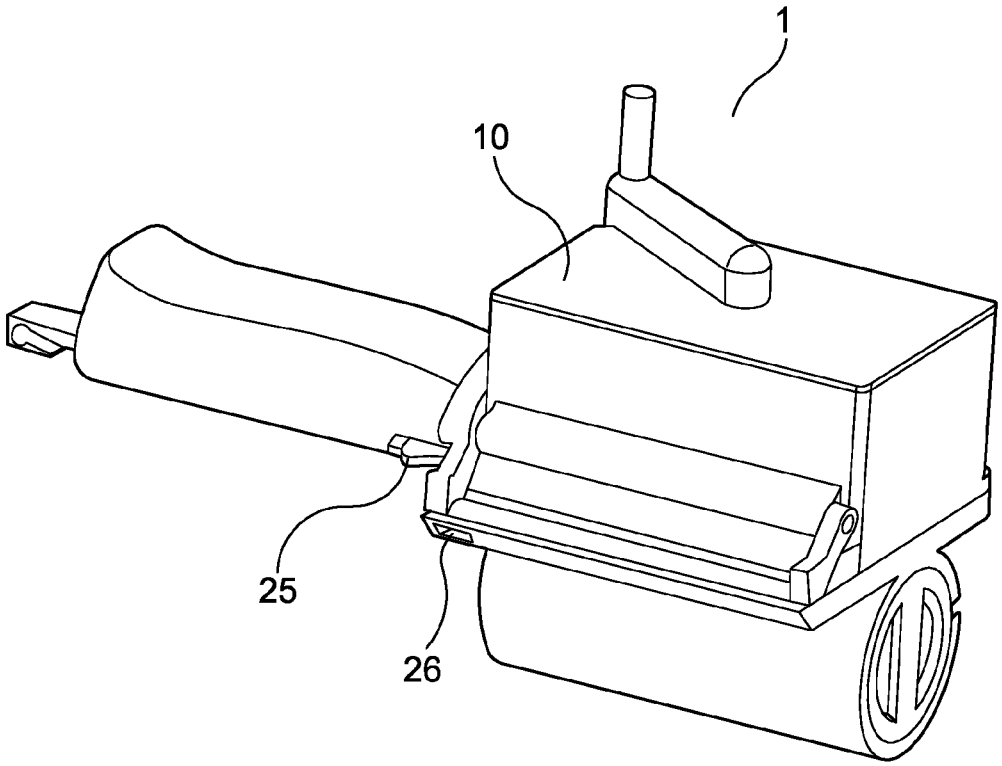
FIG. 4 is another perspective view of the device of FIG. 1.
Figure 5:
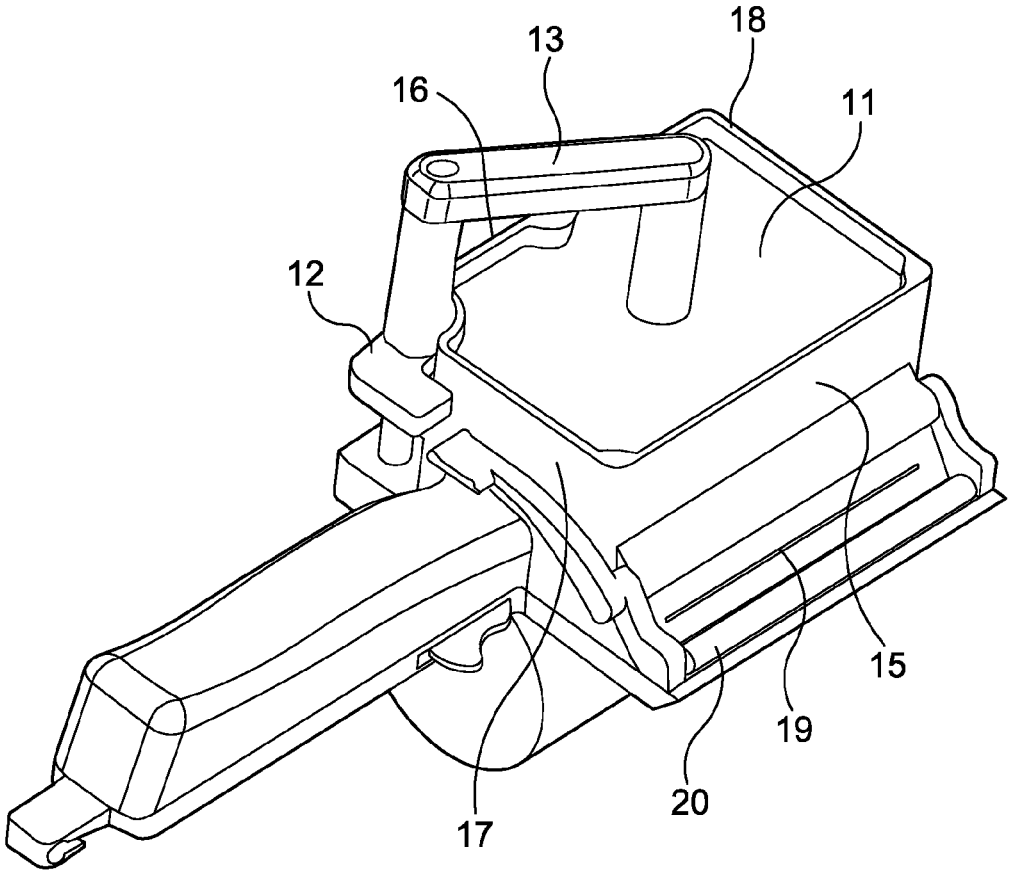
FIG. 5 is a perspective view of the device of FIG. 1 with the top plate of the reservoir removed so as to show the plunger mechanism of the reservoir.
Figure 6:
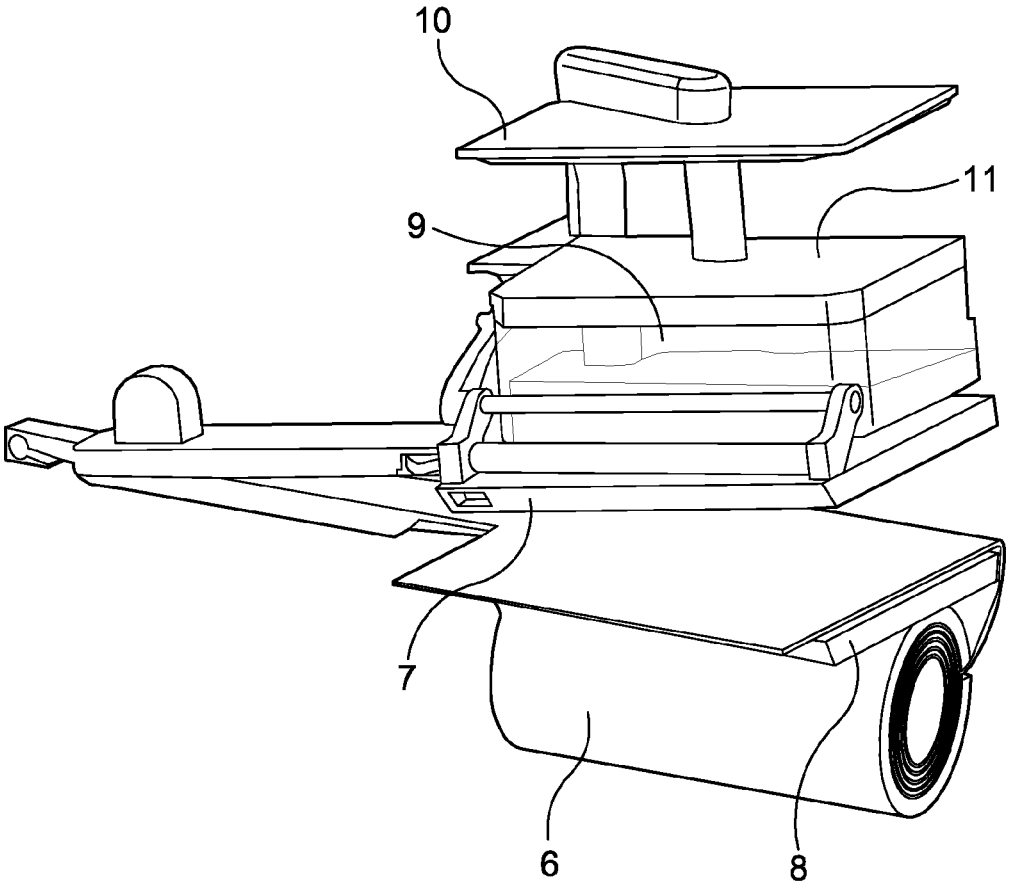
FIG. 6 is an exploded perspective view of the device of FIG. 1 wherein the reservoir walls not present so as to show the plunger mechanism therein.

Referring to the drawings, a hair-highlighting device 1 comprises a handle 2 split into upper part 2*a* and lower part 2*b*. Upper part 2*a* is hinged to lower part 2*b* at proximal end 4 of handle 2.

Adjacent distal end 5 of handle 2, upper handle part 2*a* is attached to upper plate 7 and lower handle part 2*b* is attached to lower plate 8.

On upper plate 7 is mounted reservoir 3 for storing a hair-highlighting composition. Reservoir 3 is substantially a rectangular cuboid in shape and has a chamber 9 that may be filled with a hair-highlighting composition, base of reservoir chamber 9 is formed from upper plate 7, upon which the chamber walls 15, 16, 17, 18 are located. First side chamber wall 15 and second side chamber wall 16 lie parallel to the longitudinal axis of handle 2, first end chamber wall 17 sits adjacent distal end 5 of handle 2 and second chamber end wall 18 sits opposite first end chamber wall 17.

Reservoir 3 further comprises a removable cover plate 10 which attached to reservoir chamber walls by means of magnets (not shown). Cover plate 10 may be temporarily removed so as to allow a user to fill reservoir chamber 9 with a hair-highlighting composition.

Reservoir 3 further comprises plunger plate 11, which is mechanically connected to plunger button 12 by means of plunger arm 13.

Plunger arm 13 is slidably mounted at one end upon rod 14 located adjacent the corner of reservoir 3 where first chamber end wall 17 and second side chamber wall 16 meet. Plunger arm 13 extends through a hole (not shown) in cover plate 10 and is attached at its other end to plunger plate 11.

Plunger button 12 is located on plunger arm 13 adjacent distal end 5 of handle 2 and is operable by a user to move plunger plate 11 by the user applying pressure to plunger button 12.

Located at a first side chamber wall 15 of reservoir 3 is reservoir outlet 19 in the form of a slot that extends substantially across the width of first side chamber wall 13.

Although in the present embodiment reservoir outlet 19 is in the form of a slot it will be apparent that many different arrangements of outlets could be used. For example the outlet might comprise a plurality of holes.

Pivotally mounted on first side chamber wall 15 and adjacent outlet 19 is sponge roller 20.

Sponge roller 20 is rotatably mounted on device 1 adjacent reservoir outlet 19 such that highlighting composition dispensed from reservoir outlet 19 alights upon roller 20. Roller 20 rotates as it is moved along a strand of hair, thereby aiding the even application of highlighting composition to the strand of hair.

Roller 20 is moveable by a user by the application of pressure to roller lever 21. Roller 20 is biased by a spring (not shown) into its normal resting position as shown in the Figures wherein the roller 20 is clamped against lower plate 8. By application of pressure to roller lever 21 a user may lift roller away from lower plate 8. This allows a user to adjust, if necessary, the position of strands of hair when device 1 is in use.

Beneath lower plate 8 is mounted tape holder 6 for storing a tape of barrier material 23 in the form of a roll. Tape holder 6 comprises tape dispensing slot 22 positioned beneath second side chamber wall 16 thereby being located on the opposite side of device 1 to reservoir outlet 19.

Turning now to device 1 in use, a user first installs a roll of barrier material, for example foil or clear plastic film, within tape holder 6.

By removing cover plate 10 and plunger plate 11 a user may fill reservoir chamber 9 with a highlighting composition. Plunger plate 11 is then positioned such that it rests on the highlighting composition and cover plate 10 is reattached such that reservoir chamber 9 is substantially sealed apart from at reservoir outlet 19.

Figure 7:
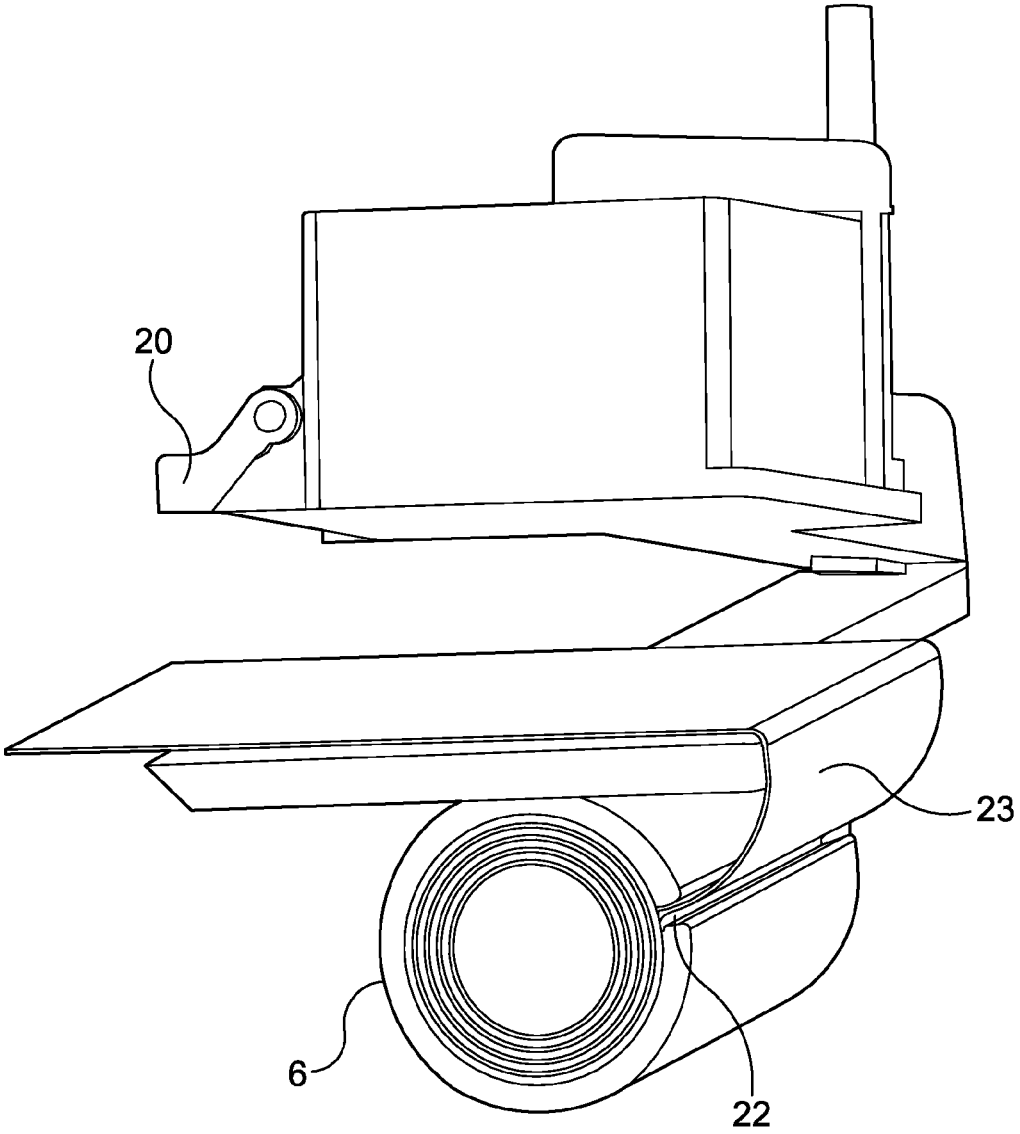
FIG. 7 is a perspective view of the device of FIG. 1 showing a tape of barrier material being retained by the device.

As handle parts 2*a*, 2*b* are hinged together at distal end 5 upper plate 7 and lower plate 8 may be moved between a first position as shown in FIG. 1 wherein the plates are adjacent to each other and a second position as shown in FIG. 7 wherein the plates are spaced from each other.

As shown in FIG. 7 a user may position the tape of barrier material 23 such that it extends from tape dispensing slot 22 and runs over lower plate 8 exiting the device from between plates 7, 8 beneath reservoir outlet 19.

Figure 8:
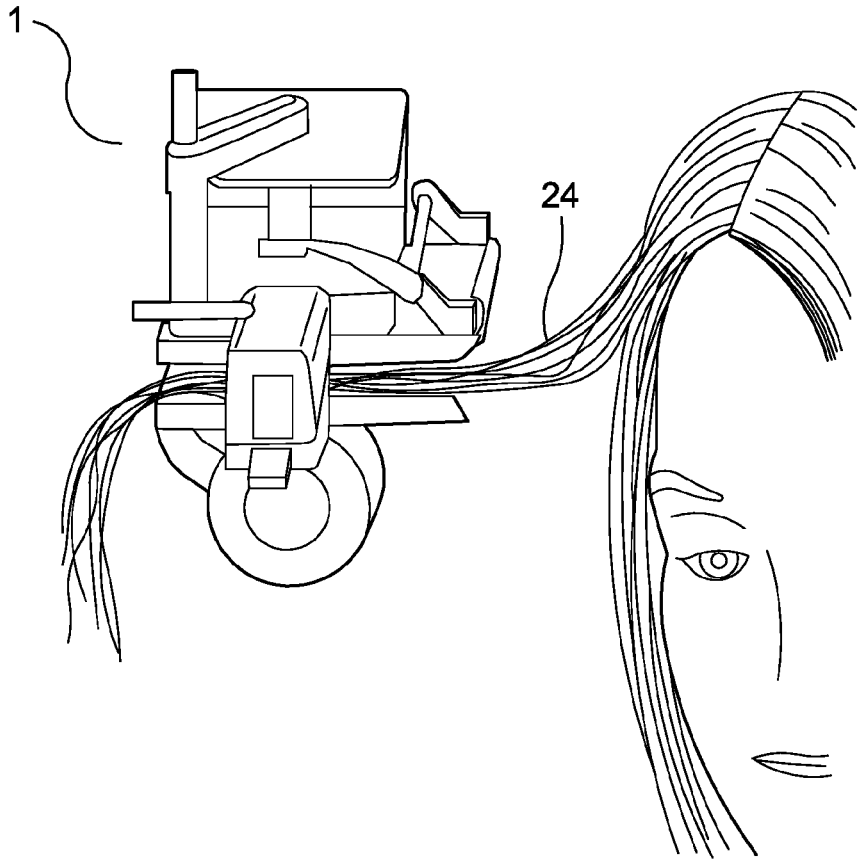
FIG. 8 is a schematic showing the device of FIG. 1 in use.

With upper and lower plates 7, 8 spaced from each other in their second position as shown in FIGS. 7 and 8 a user may place a lock of hair 24 between plates 7, 8 and then move plates 7, 8 into their first position such that the plates are clamped upon lock of hair 24.

The hand of a user when grasping handle 2 naturally maintains a pressure on handle parts 2*a*, 2*b* such that lock of hair 24 is held between plates 7, 8.

A user may then dispense highlighting composition from reservoir outlet 19 onto roller 20 and subsequently onto lock of hair 24 by applying pressure to plunger button 12 with their thumb. The user is able to vary the amount of highlighting composition dispensed by varying the amount of pressure applied to plunger button 12.

The user may move device 1 such that lock of hair 24 passes through it and thereby release highlighting composition onto lock of hair 24 along the full length thereof.

If necessary the user may operate roller lever 21 so as move roller 20 to a position wherein it is not clamped against lower plate 8. This allows the user to rearrange the strands of hair as required.

Simultaneously to dispensing highlighting composition barrier material 23 is also dispensed from device 1 such that once the device has traveled the length of lock of hair 24 it is encased in the barrier material by the user having folded or crimped barrier material 23 around the lock of hair with their other hand.

When lock of hair 24 has been coated with composition and encased in barrier material along its full length, the user may operate roller lever 21 so as move roller 20 to a position wherein it is not clamped against lower plate 8. The user may then dispense a length of barrier material that does not have highlighting composition applied to it.

The user may then actuate trigger 25, which extends a small blade (not shown) from aperture 26 in lower plate 8 thereby making an incision in the side of the tape of barrier material and allowing the tape to be torn across its width.

The length of barrier material that does not have highlighting composition applied to it may then be folded over onto the length of barrier material behind the hair so as to sandwich the hair in barrier material.

The user may then apply the device to a further lock of hair and repeat until the highlighting process has been completed.

It will be apparent that many variations are possible without departing from the scope of the present invention as set out in the appended claims.

The invention claimed is:

1. A hair-highlighting device comprising: a handle and a reservoir for storing a highlighting composition, the reservoir including a reservoir outlet for dispensing the highlighting composition;

the hair-highlighting device being adapted to simultaneously dispense a tape of barrier material and the highlighting composition to a length of a lock of hair as the hair-highlighting device passes along the length of the lock of hair, and;

the device comprises a manually operated mechanism to expel the highlighting composition from the reservoir such that when the hair-highlighting device is in use a user may vary the amount of the highlighting composition that is dispensed from the reservoir along the length of the lock of hair by varying the pressure that is applied to the manually operated mechanism, the manually operated mechanism includes a movable actuator and a movable device, the actuator is configured to cause the moveable device to move in the reservoir to cause dispensing of the highlighting composition through the reservoir outlet of the reservoir, the manually operated mechanism is configured to enable a user to vary the amount of the highlighting composition that is dispensed through the reservoir outlet of the reservoir by varying the pressure that is applied to the actuator, whereby the device can be operated by the user to selectively vary the amount of the highlighting composition that is dispensed along the length of the lock of hair.

2. The device of claim 1 comprising an attachment to retain a roll of barrier material such that the roll is rotatably attached to the device.

3. The device of claim 1 wherein the mechanism to expel the highlighting composition comprises a button adjacent the handle.

4. The device of claim 3 wherein the button is operable by a user's thumb.

5. The device of claim 1 wherein the reservoir outlet is formed so as to release highlighting composition substantially across the width of the tape of barrier material.

6. The device of claim 1 wherein the reservoir outlet is in the form of a slot.

7. The device of claim 1 comprising a roller adjacent the reservoir outlet to assist application of highlighting composition.

8. The device of claim 7, further comprising a roller lever and wherein the roller is moveable between a first position and a second position by the user actuating the roller lever, the roller is in the first position when the device is in use the roller is clamped upon a lock of hair in the device and the roller in a second position wherein the roller is raised away from the lock of hair, and wherein the roller lever enables the user to adjust the position of strands of hair in the hair-highlighting device while using the hair-highlighting device to highlight the hair.

9. The device of claim 8 wherein the roller is biased towards its first position.

10. The device of claim 8 wherein the roller may be moved into its second position by a user applying pressure to the roller lever that is positioned adjacent the handle.

11. The device of claim 1 wherein the barrier material is a transparent plastic film.

12. The device of claim 1 comprising a cutter operable to cut the barrier material.

13. The device of claim 12 wherein the cutter is operable by a trigger adjacent the handle.

14. The device of claim 12 wherein the cutter is adapted to make an incision in one side of the tape of barrier material.

15. The device of claim 1 wherein the device is formed of first and second parts hingedly attached adjacent an end of the handle, the parts being moveable between an open position wherein the lock of hair may be positioned in the device and a closed position wherein the barrier material and highlighting composition may be applied to the lock of hair.

16. The device of claim 1 wherein the reservoir is refillable.

17. The device of claim 1 wherein the reservoir may hold at least 100 ml of highlighting composition, more preferably at least 150 ml of highlighting composition, more preferably at least 200 ml of highlighting composition, and more preferably at least 250 ml of highlighting composition.

18. A hair-highlighting device comprising:

a handle, the handle formed of an upper part and a lower part that are hingedly connected together and wherein the upper part and the lower part are movable between an open and closed position;

an upper plate connected to the upper part of the handle;

a lower plate connected to the lower part of the handle, the upper plate overlies the lower plate and the upper and lower plates are positioned adjacent one another when the handle is in the closed position;

a reservoir connected to the upper plate, the reservoir is configured to store a highlighting composition, the reservoir including a reservoir outlet to enable the highlighting composition in the reservoir to be expelled from the reservoir;

a manually operated mechanism that includes a movable actuator and a movable device, the actuator is configured to cause the moveable device to move in the reservoir to cause dispensing of the highlighting composition through the reservoir outlet of the reservoir, the actuator configured to be actuated by a user while the user simultaneously grasps both the upper and lower parts of the handle, the manually operated mechanism configured to enable a user to vary the amount of the highlighting composition that is dispensed through the reservoir outlet of the reservoir by varying the pressure that is applied to the actuator; and, a tape holder connected to the lower plate, the tape holder configured to hold a barrier material, the tape holder configured to enable the barrier material to be dispensed from the tape holder;

wherein the hair-highlighting device is configured to simultaneously dispense a tape of barrier material and the highlighting composition along a length of a lock of hair as the hair-highlighting device passes along the length of the lock of hair, and, wherein the hair-highlighting device can be operated by the user to selectively vary the amount of the highlighting composition that is dispensed along the length of the lock of hair, and, wherein when the lock of hair is positioned between the upper and lower plates when the handle is in the closed position, the barrier material is positioned above a top surface of the lower plate and the lock of hair is positioned above a top surface of the barrier material and the actuation of the actuator by the user causes the highlighting composition to be applied to the lock of hair that is positioned on the top surface of the barrier material.

19. The hair-highlighting device as defined in claim 18, further including a roller that is rotatably mounted adjacent to the reservoir, the roller configured to aid in the even application of the highlighting composition to the length of the lock of hair.

20. The hair-highlighting device as defined in claim 19, wherein the roller is biased downwardly toward a top surface of the lower plate by a biasing arrangement.

21. The hair-highlighting device as defined in claim 20, further including a roller lever configured to lift the roller upwardly and away from a top surface of the lower plate, the roller lever configured to be actuated by a user while the user simultaneously grasps both the upper and lower parts of the handle, and wherein the roller lever enables the user to adjust the position of strands of hair in the hair-highlighting device while using the hair-highlighting device to highlight the hair.

22. The hair-highlighting device as defined in claim 21, further including a barrier material cutter having a cutter actuator, the barrier material cutter configured to cut the barrier material when a user actuates the cutter actuator, the barrier material cutter configured to be actuated by a user while the user simultaneously grasps both the upper and lower parts of the handle.

23. The hair-highlighting device as defined in claim 18, wherein the roller is biased downwardly toward a top surface of the lower plate by a biasing arrangement.

24. The hair-highlighting device as defined in claim 18, further including a roller lever configured to lift the roller upwardly and away from a top surface of the lower plate, the roller lever configured to be actuated by a user while the user simultaneously grasps both the upper and lower parts of the handle, and wherein the roller lever enables the user to adjust the position of strands of hair in the hair-highlighting device while using the hair-highlighting device to highlight the hair.

25. The hair-highlighting device as defined in claim 18, further including a barrier material cutter having a cutter actuator, the barrier material cutter configured to cut the barrier material when a user actuates the cutter actuator, the barrier material cutter configured to be actuated by a user while the user simultaneously grasps both the upper and lower parts of the handle.

26. The hair-highlighting device as defined in claim 18, wherein the reservoir is configured to provide the only source of highlighting composition to a lock of hair as the lock of hair passes through the hair-highlighting device.

27. The hair-highlighting device as defined in claim 18, wherein opposing surfaces of the upper and lower plates are planar surfaces.

* * * * *